US005119646A

United States Patent [19]

Jacumin

[11] Patent Number: 5,119,646

[45] Date of Patent: Jun. 9, 1992

[54] BLEACHING KIER FOR CONTINUOUS BLEACHING OF ELONGATED CLOTH

[76] Inventor: Jimmy R. Jacumin, Rte. 3, Box 173, Connelly Springs, N.C. 28612

[21] Appl. No.: 664,307

[22] Filed: Mar. 4, 1991

[51] Int. Cl.[5] ..... D06B 3/24; D06B 23/02; B65H 20/02

[52] U.S. Cl. ..... 68/13 R; 68/176; 68/177; 68/181 R; 242/55.01; 226/34; 226/43; 226/108

[58] Field of Search ..... 242/55.01, 47.5, 47.01, 242/47.08, 47.09; 226/108, 34, 42, 43; 68/177, 181 R, 13 R, 176

[56] References Cited

U.S. PATENT DOCUMENTS

| | | | |
|---|---|---|---|
| 1,918,237 | 7/1933 | Alden | 242/47.09 |
| 3,491,964 | 1/1970 | Warrington | 242/47.09 |
| 3,894,411 | 7/1975 | Stanway | 68/70 |
| 4,182,141 | 1/1980 | Sando et al. | 68/177 |
| 4,291,555 | 9/1981 | Barriquand | 68/177 |
| 4,425,842 | 1/1984 | Winch et al. | 100/37 |
| 4,434,633 | 3/1980 | Winch et al. | 68/267 |
| 4,440,003 | 4/1984 | Koch | 68/177 X |

FOREIGN PATENT DOCUMENTS

| | | | |
|---|---|---|---|
| 22464 | of 1901 | United Kingdom | 242/47.09 |

*Primary Examiner*—John M. Jillions
*Attorney, Agent, or Firm*—Roy B. Moffitt

[57] ABSTRACT

A bleaching kier comprising a compartment of container into and out of which flaccid material is conveyed, in combination with (a) a control device for controlling the amount of elongated cloth being conveyed to the compartment, (b) a device for conveying the elongated cloth along a predetermined path without imparting a crease thereto, and (c) a device for removing a large portion of bleaching liquor from the elongated cloth prior to it being conveyed to a washer. The control device includes a drum with a plurality of upstanding members on its outer surface for engaging and conveying the elongated cloth to the compartment and a "U" shaped member, adapted to be moved from a first position, where the elongated cloth is in contact with the upstanding members, to a second position where the elongated cloth is not in contact therewith. The device for moving the elongated cloth along a predetermined path includes first and second rotatable axles disposed apart from and the longitudinal axis of the axles at an angle one to another. A first set of pulleys are disposed on the first axle and a second set of pulleys on the second axle. An elongated cloth member is traversed over the pulleys and when the axles and pulleys are rotated, the elongated cloth moves along a predetermined path without a crease being imparted thereto. A pair of spaced apart squeeze rolls and gas jet is provided so that partially inflated tubular flaccid material, is partially compressed by the rolls.

18 Claims, 11 Drawing Sheets

BLEACHING KIER FOR CONTINUOUS BLEACHING OF ELONGATED CLOTH

BACKGROUND OF THE INVENTION

The field of the invention deals with the continuous bleaching of an elongated mass of flaccid material, namely a tubular mass of knitted fabric such as cotton cloth or blend of two or more materials. Prior art bleaching kiers employ the combination of a dry "J" box (a storage device), a saturator, a bleaching kier and a washer. See the schematic shown in FIG. 1 for example. Elongated tubular shaped knitted cotton in a rope like configuration is moved by squeeze rolls 6 into the dry "J" box where up to 2,500 pounds of cloth are stored, about a one and one-half hour supply to the balance of the bleaching apparatus. From the dry "J" box, the cloth is conveyed, again by squeeze rolls 10—10 and 10'—10', to and through a saturator, where the cloth is saturated with bleaching liquor. After saturation, the cloth is conveyed, also by squeeze rolls 10—10 and 11—11 into and out of the bleaching kier, where the cloth is traversed along a predetermined path for a given length of time. Subsequently, the cloth is removed from the bleaching kier, again by squeeze rolls 11—11, placed in a washer where excess bleaching liquor is removed, removed from the washer (again by squeeze rolls), dried and thus prepared for manufacture into finished goods.

Certain problems have been identified by users of prior art bleaching apparatus, such as the use and associated cost of a saturator, excessive creasing of the cloth while it is in a rope like configuration by the squeeze rolls, inability to accurately control the flow of cloth through the bleaching kier and inefficient removal of bleaching liquor from the cloth prior to its transmittal to the washer. It is towards the solution of these problems that the instant invention is directed.

Reference is made to FIG. 1 where there is shown, in schematic form by element 1, a cross section of a typical prior art bleaching kier. Goods to be bleached 4 are in a rope like configuration and are received in a wound configuration 3. They are placed in a device called a cradle 98. By means of squeeze rolls 5—5, the rope like elongated flaccid material (cloth) 4 is conveyed into a sewing scray where the end member 4 of a preceding length of cloth is affixed to the end member of another roll of cloth 4 by sewing. By means of squeeze rolls 6, cloth 4 is pulled through entrance guide 8 and into dry J-box 27 where it is stored. When needed, it is removed from dry J-Box 27 through exit guide 8 and put into saturator 9, where it is allowed to become saturated with bleach liquor. After saturation and when there is room for more cloth in bleaching kier 12, cloth 4 is removed from saturator 9 by squeeze rolls 10, conveyed over drum 28 into water slide 61 where it comes into contact with additional bleaching liquor, through device 19, to traverse it down (towards the left) of slide 61. Bleach liquor 14 is held in container 13 and cloth 4 is moved through container 13 and bleach liquor 14 therein by drum or roll 28 and liquor flor from element 19. Squeeze rolls 11, moves cloth 4 from kier 12 to counter flow washer 15. Cloth 4 is moved through counter flow washer 15, where the bleach liquor is removed, and cloth 4 deposited in wet box 18 for subsequent drying and further processing into finished goods.

Unacceptable creasing of the rope like configurated cloth 4 by squeeze rolls 6, 10—10, 10'—10' and 11—11 and the control of the movement of cloth 4 out of the dry J-Box into and through kier 12 are the problems addressed by the present invention.

SUMMARY OF THE INVENTION

The disclosed invention is an improved bleaching kier, which in the main is a compartment or container into and out of which an elongated rope like configurated cloth (flaccid material) is conveyed, in combination with (1) a control device for controlling the amount of elongated cloth being conveyed to the kier compartment, (2) a device for conveying the elongated cloth into and out of the container without imparting a crease thereto, and (3) a device for removing a large portion of bleaching liquor from the cloth prior to it being conveyed to a washer. Prior art bleaching systems required a dry "J" box, a saturator, a bleaching kier and a washer. This invention removes the necessity of a saturator, yet preserves its function and can completely eliminate unacceptable creasing arising out of using rolls or rope like configurated elongated tubular flaccid material.

The bleaching kier of this invention is composed of a large water tight compartment in which there is disposed two sets of a plurality of juxtaposed troughs, an upper and lower side by set, through which elongated flaccid material (cloth) is traversed. These troughs cause the cloth to be guided from one side of the kier to the other over predetermined back and forth, front to back paths all delimited by the troughs. The cloth is traversed first over an upper trough member (sometimes referred to as a water slide), then into the lower portion of the kier into a lower trough which contains bleaching liquor bath, over a control device and then into and down an adjacent upper trough and then again into another lower trough in the bleaching liquor bath. This procedure is repeated until the cloth moves from one side to the opposite side of the kier through a plurality of troughs, i.e., from one outside trough member to an opposite outside trough member. To control this movement, so that a predetermined mass of cloth is in the kier at any given time, a certain control system 21 is used.

A part of the control system includes a control device that includes a reel or a drum 28, disposed over one of the terminal portions of the upper and lower troughs, having a plurality of upstanding members on its outer surface. These upstanding members engage the cloth as it first enters the kier from the dry "J" box, conveys it to a waterslide (a plurality of side by side troughs) where the cloth is moved to the far opposite end of the kier. The cloth is then conveyed to and through a trough submerged in bleach liquor back to the drum of the control device. A moveable "U" shaped member, through which the elongated cloth is threaded, is positioned near the drum or reel and is used to move the elongated cloth from a first position, where the elongated cloth is in contact with the upstanding members, to a second position where the elongated cloth is not in contact therewith, all in response to the determination of the presence or absence of a predetermined mass of flaccid material in one or more of a plurality of troughs in the kier. Obviously, while the elongated cloth is in contact with the control device, elongated cloth is being fed into the kier troughs. When there is no such contact, the feeding is stopped.

The invention is a bleaching kier that includes a unique set of control devices and sensors, all working together, to control the flow of elongated flaccid material through the bleaching kier. There is an entrance and a exit end to the kier, through which the elongated flaccid (rope like) tubular material enters and exits the bleaching liquor of the kier. At the entrance end there is a control device 21 made up of a rotatable drum 28 that feeds the elongated flaccid material into the kier, the body of which is composed, in the main, of one set of troughs spaced above another set of troughs, the uppermost set of troughs disposed at a slight angle to the longitudinal axis of the lower set of troughs. Each trough of the lower set has a movable perforated grate, movable from a first to a second position when the cloth piles up at the grate beyond a predetermined mass. The grate, in the laterally outermost trough (lower trough nearest to the point the elongated cloth enters the kier) is connected to a drive motor that drives the rotating control device 28 and a device for conveying the elongated flaccid material (cloth). When the grate is moved by an unwanted accumulation of flaccid material from a first to a second position, such movement causes the drive motor to slow down or stop, thus reducing the input of elongated flaccid material into the kier. In all other lower compartments, the grate is connected to a switch, connected to a piston of a moving device, which when activated moves the "U" shaped arm, through which the elongated flaccid material is threaded, from a first position (cloth in contact with rotatable drum) to a second position where the cloth is not in such contact. When the unwanted accumulation is removed, the grate moves from its second to first position, causing the moving device to move the "U" shaped arm from its second to its first position, where the cloth is in contact with the ribs of the drum.

In addition to the above, there are sensors, like the one available from Bernhard Inc. Kennett Square, Pa., Model 7000, positioned at the exit end of each upper trough, the end opposite from the location of the grate. The sensor is in the outermost lateral upper trough (the uppermost trough at the extreme left viewing the kier at the entrance end) is connected to a drive motor that drives the control device (the drum) and the device for conveying elongated flaccid material. When the first mentioned sensor, the one in the outermost lateral trough, is activated by an accumulation of unwanted cloth, it deactivates or slows down the drive motor that rotates the control drum 28 and conveying device. Removal of the unwanted cloth accumulation reverses this state. Each of the other sensors in the upper troughs, are connected to a switch in the adjacent trough, which activates a piston (moving device) which in turn moves the above mentioned "U" shaped arm in the above described manner.

In combination with the above is a device to remove the elongated flaccid material from the dry "J" box, feed it to the bleaching kier (no saturator is required). This same device can be used to remove the cloth from the washer and deposit it in a wet box, if desired. This conveying device is composed of first and second rotatable axles disposed apart from and at an angle one to another. A first set of pulleys are disposed on the first axle and a second set of pulleys on the second axle. The elongated cloth member is traversed over the pulleys and when the axle and pulleys are rotated, the elongated cloth moves along a predetermined path without imparting a crease to the cloth. The diameter of one of the pulleys is greater than the diameter of the other pulleys.

After the cloth has finished its travels in the bleaching kier, it is removed from the kier simultaneously removing a large quantity of the bleaching liquor from the cloth, which is allowed to flow back into the kier. Such is accomplished by use of a spaced apart pair of squeeze rolls and a gas jet. These rolls and gas jet are positioned so that the elongated tubular flaccid material, while being pulled by the above described rolls, is partially inflated by gas in the cloth and from an external source. Such a combination expels a large quantity of the bleach liquor from the cloth, which is allowed to fall back into that portion of the kier in which the bleaching liquor is contained, while imparting only two laterally disposed acceptable creases in some but not all types of fabric.

DETAILED DESCRIPTION OF THE INVENTION

Figure 1:
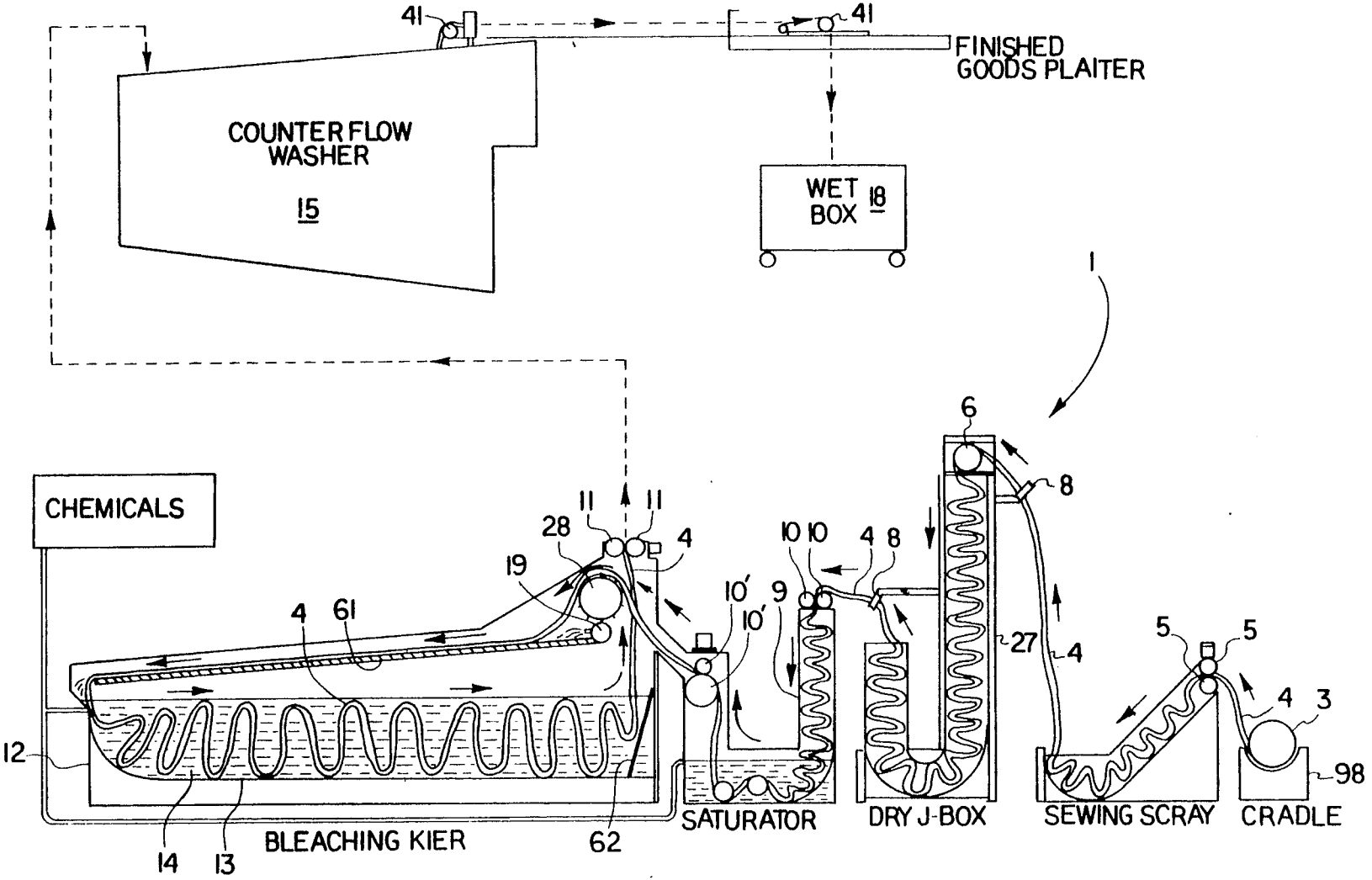
FIGURE 1 PRIOR ART
FIG. 1 is a cross sectional schematic of a prior art bleaching system employing a cradle, a sewing scran, a dry J-box, a saturator, a bleaching kier, a counter flow washer and a wet box.
Figure 2:
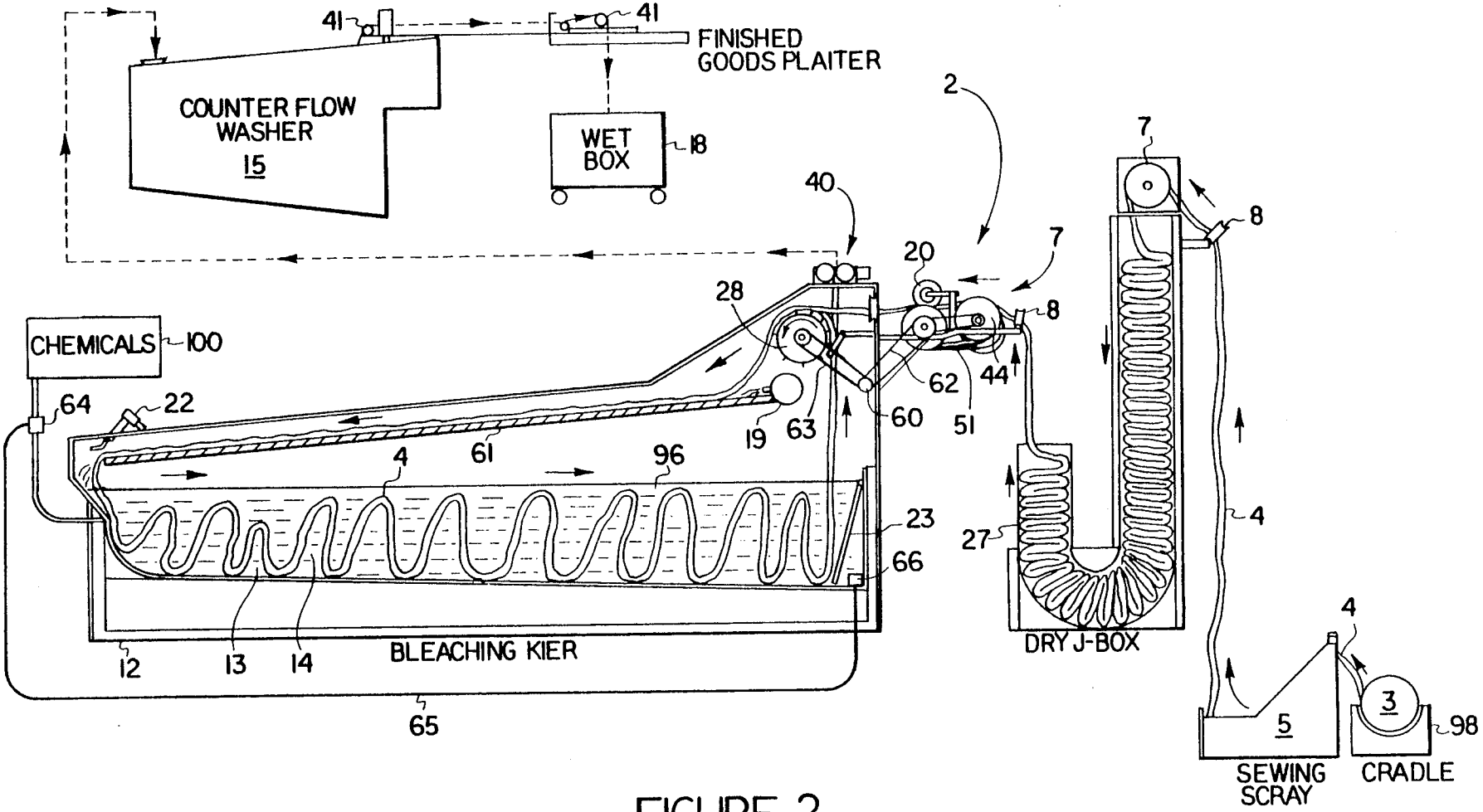
FIG. 2 is a cross-sectional schematic of the bleaching system of the present invention employing a cradle, a sewing scray, a modified dry J-box, a modified bleaching kier, a counter flow washer and a wet box.
Figure 6:
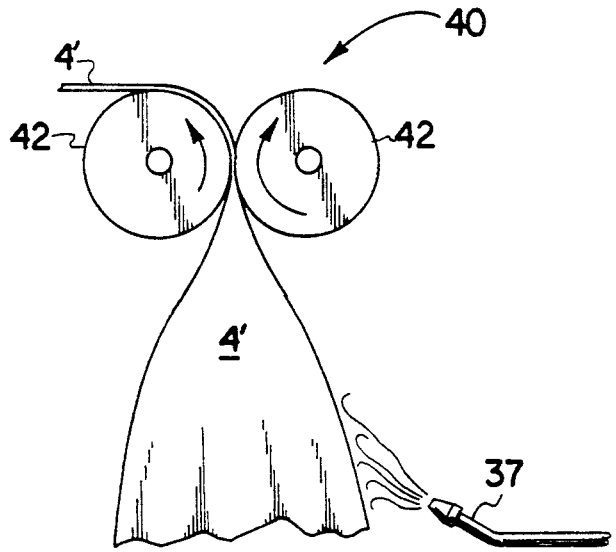
FIG. 6 is a partial side view of the apparatus used with flaccid material 4 as it exits bleaching kier 12 and before it enters into tube 43 to be transported by water by a water jet from kier 12 to counter flow washer 15.

Reference is made to FIG. 2, where the invention is #shown generally by element 2. Comparing prior art bleaching system 1 with invention 2, one can immediately identify several differences, for example, the absence of saturator 9 and squeeze rolls 11—11 for that part of the bleaching system where the cloth 4 is in a rope like configuration. To appreciate this last mentioned feature, from squeeze rolls 40 (FIG. 2) to wet box 18 the goods are in an extended condition, like that shown by element 4' of FIG. 6, all of which will be later explained in more detail.

Figure 10:
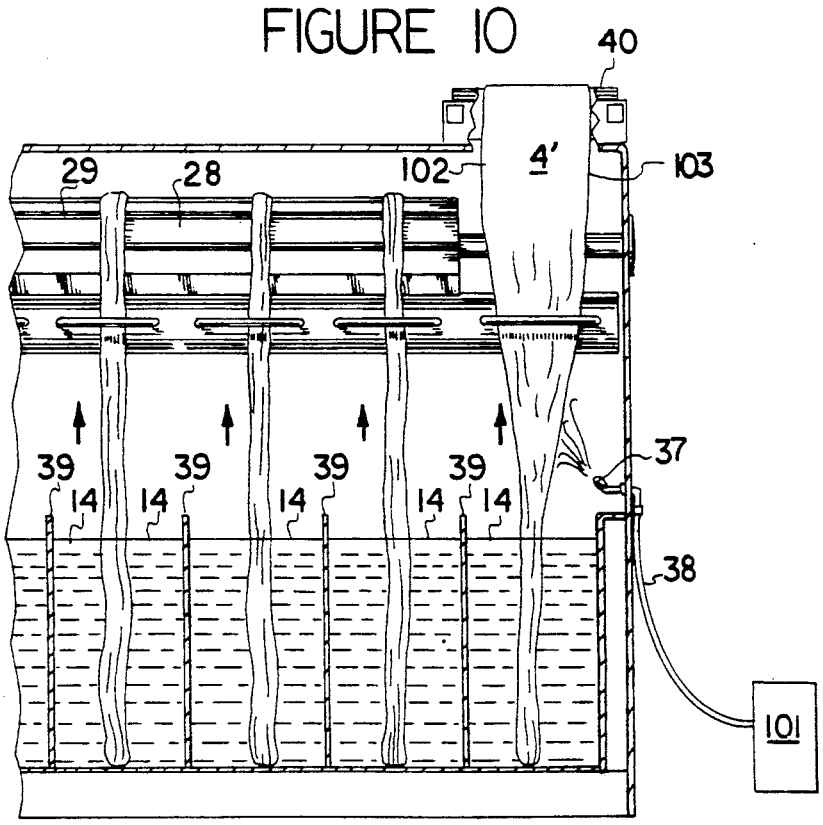
FIG. 10 is a fragmentary front elevation of the right hand terminal portion of FIG. 3.
Figure 11:
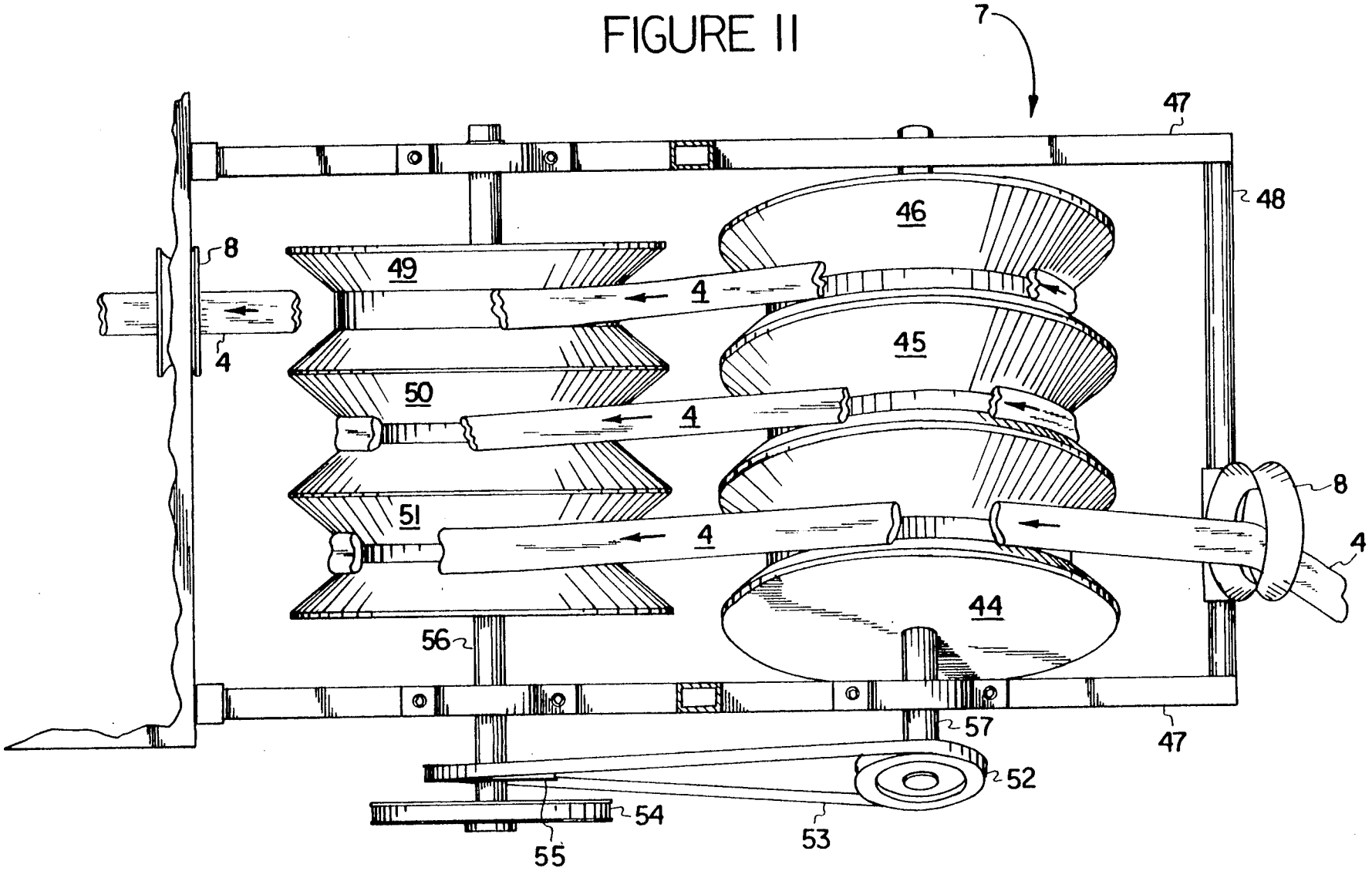
FIG. 11 is a plan detailed view of the moving device 7 of FIG. 2.

As shown by FIG. 2 rope like cloth 4 wound in a bundle 3 is removed from cradle 98 and sewing scray 5 through guide 8 by conveying device 7, shown in detail by FIG. 11. Responsive to signals received from elements yet to be described coming from the bleaching kier, another conveying device 7, affixed to the kier, removes cloth 4 to be bleached from the dry J-box through guide 8 over control drum 28 and onto water slide 61. Water slide 61 is actually a plurality of juxtaposed first set of troughs 25-1 through 25-7 (see FIG. 3), which are disposed at a slight angle to the longitudinal axis of kier 12 and are spaced apart from and above a second set of troughs located in the bottom of kier 12. Note trough walls 39 of FIG. 10 and dotted lines of FIG. 3. This second set of troughs are submerged in the main body of bleaching liquor 96. Transducer 66 is disposed in the body of bleaching liquor 96 and is responsive to the quantity of bleaching liquor 14 in kier 12, i.e. the level of the liquor. When a predetermined level 96 of liquor is reached, switch 64 is activated to control and supply chemicals from container 100. The body of bleaching liquor 14 is kept within a predetermined temperature range by circulating the liquor through counter current heat exchanger 24. See FIG. 3.

Figure 3:
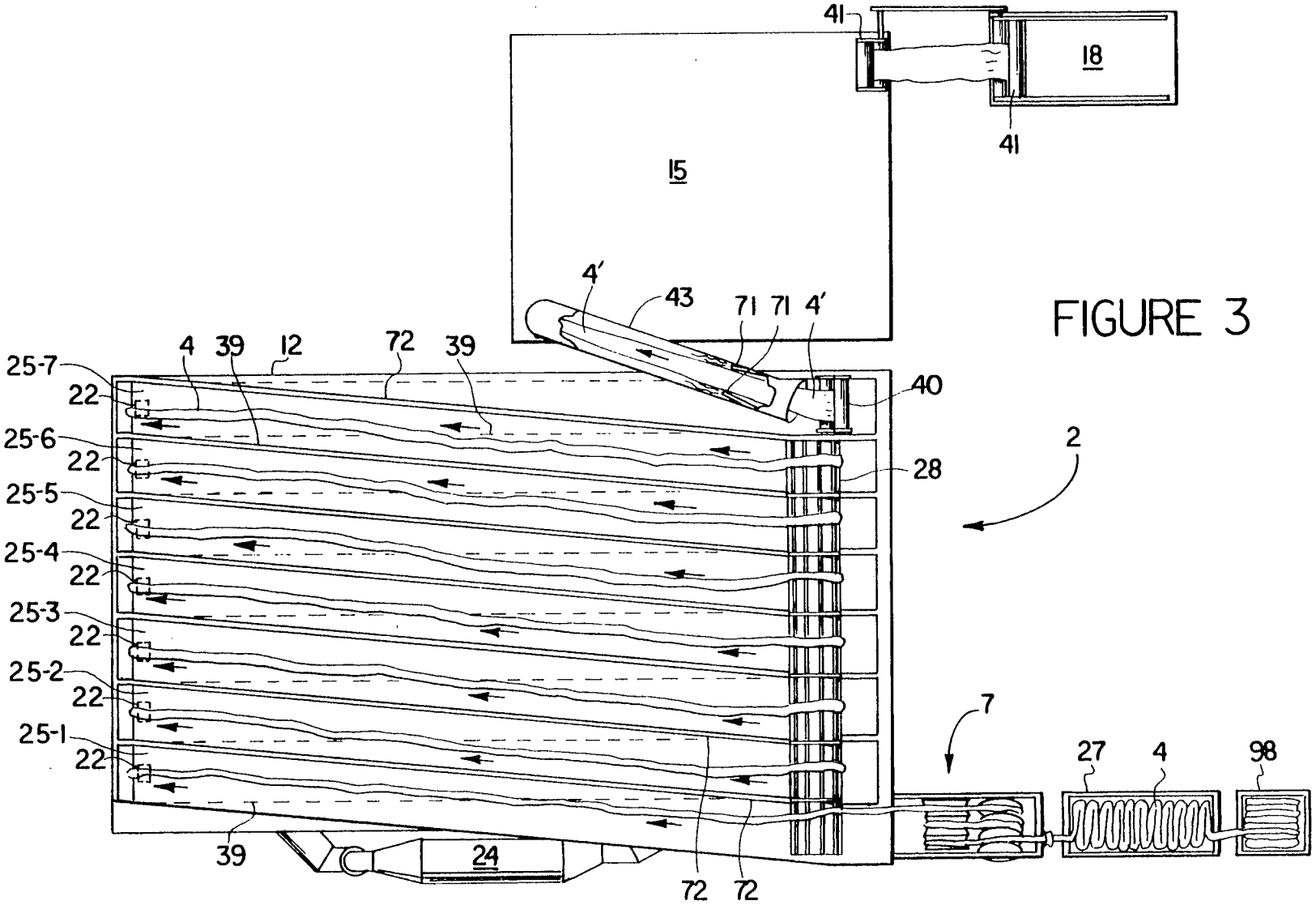
FIG. 3 is a plan view of the bleaching system 2 of FIG. 2.

Additional features of the invention are disclosed in FIG. 3. Drum 28 is shown to extend the width of kier 12 and it operates as a cloth control in conjunction with a rack 30 and pinion gear 31 and "U" shaped member 35, shown more in detail in FIGS. 4 and 5, which will be explained more fully at a later date. Cloth 4', in an extended and bleached state, is pulled by squeeze rolls 42 (FIG. 6) through exit 40 into tube 43 where it is propelled by water from jets 71 through tube 43 to counter flow washer 15.

From counter flow washer 15 cloth 4' is conveyed in its extended form through squeeze rolls 41 to wet box 18. It is to be understood, however, that cloth 4' (extended state) can be configured into a rope like state, i.e. element 4, while in counter Washer 15. If so, squeeze rolls 16 and 41 may be replaced by conveying device 7, in order to decrease creases in the bleached goods.

Figure 4:
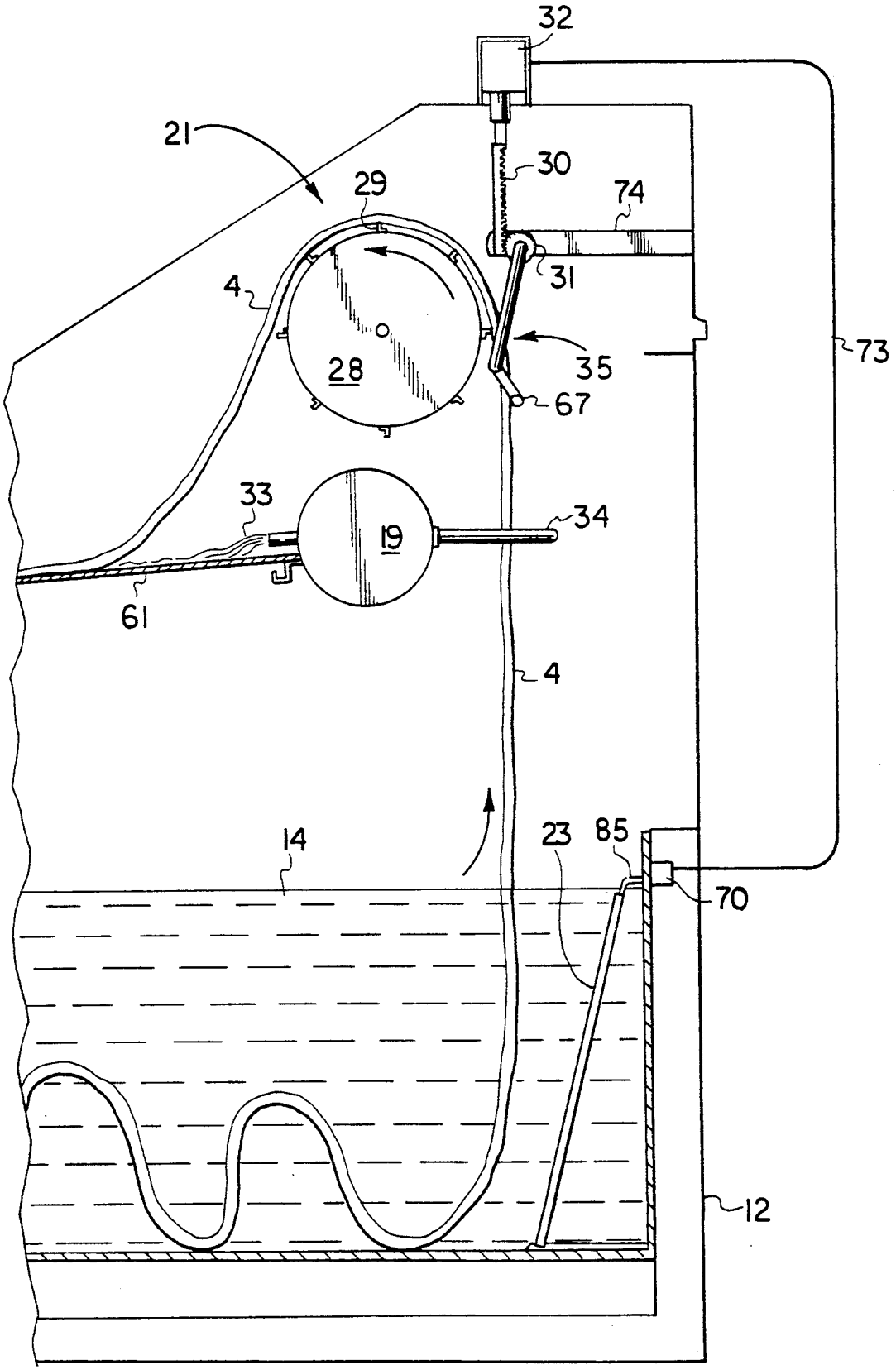
FIG. 4 is a fragmentary front elevation of kier 12 and a control apparatus in a first position to control the feed of flaccid material into the kier via water slide 61.
Figure 5:
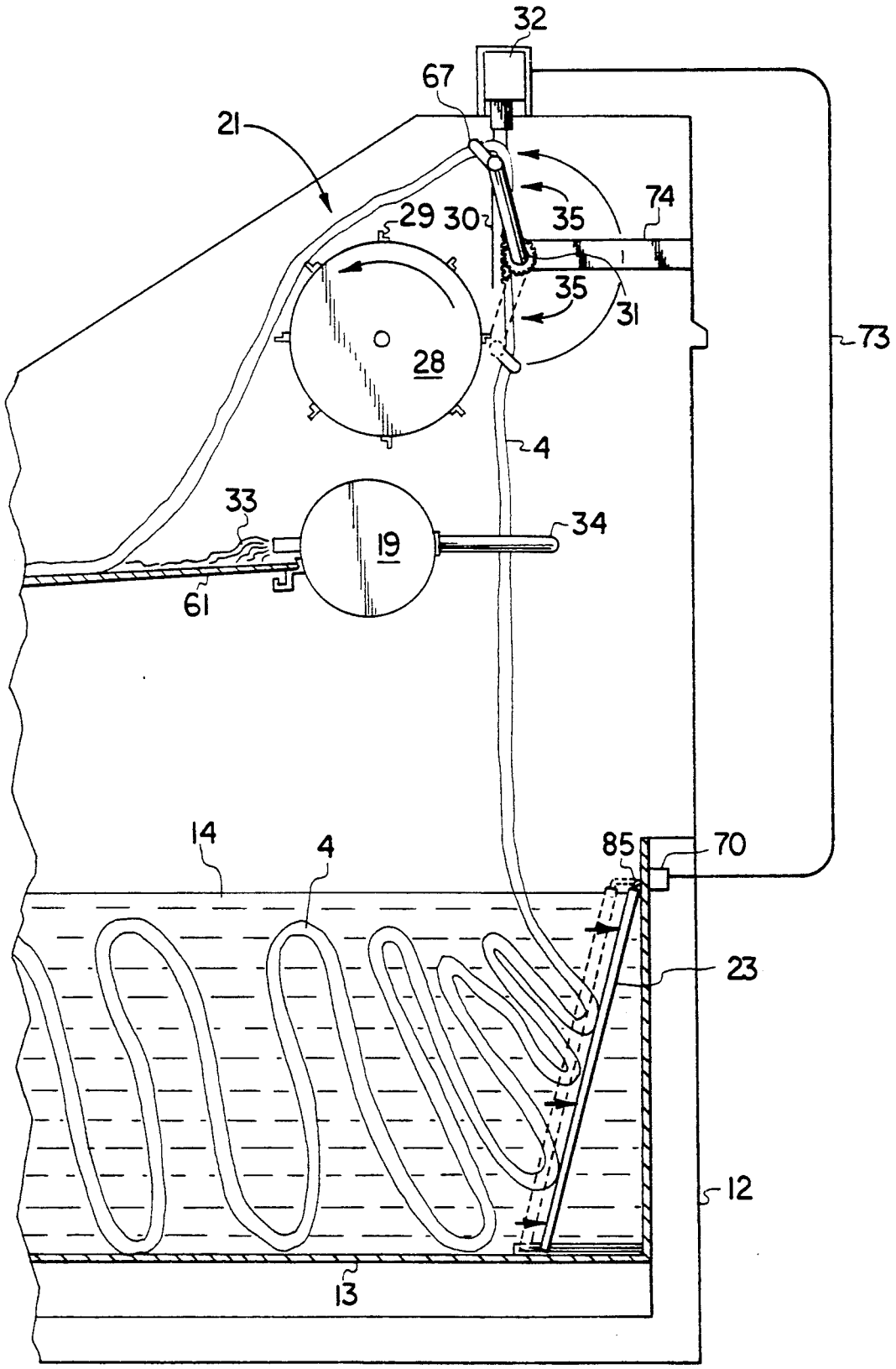
FIG. 5 is a replica of FIG. 4, except that the control apparatus is in a second position.
Figure 7:
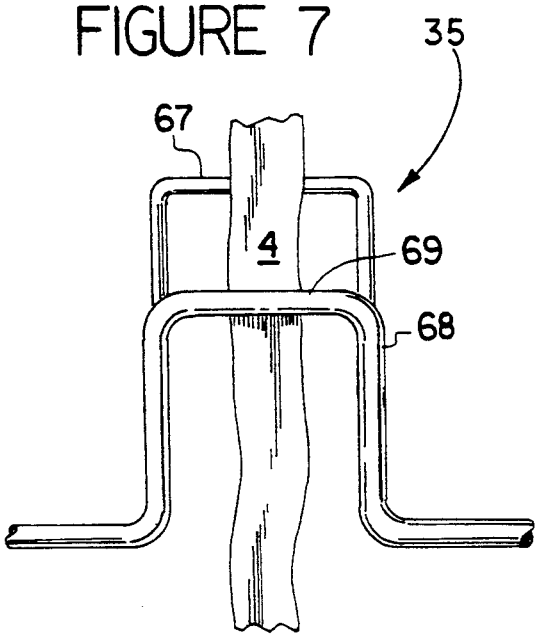
FIGS. 7 and 8 are front and side elevation view of control arm 35 of FIGS. 4 and 5 threaded with flaccid material 4.
Figure 8:
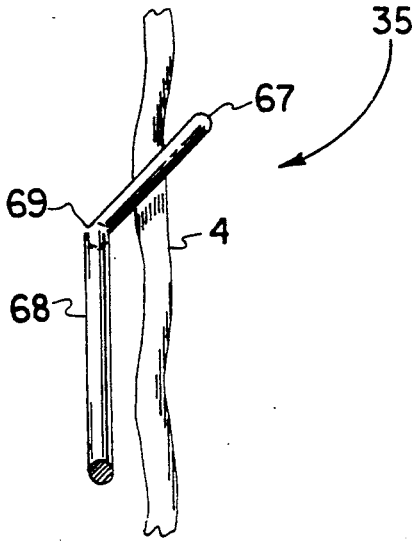

Attention is now directed to FIGS. 4 and 5, where there is shown generally by element 21, a control device, located at one terminal end portion of the bleaching kier 12. Each trough of the second set, the lower set of troughs, are delimited in part by upstanding side walls 39 and have a grate 23 disposed thereon. Grate 23 is pivotably responsive to an unwanted accumulation of a mass of cloth 4 piling up next to and pressing against it. Grate 23 is perforated (not shown) so that liquid may pass, but not cloth, and is movable from a first to a second and from the second to the first position. Compare FIGS. 4 and 5. In the first position, FIG. 4, cloth 4 is not piled up on grate 23, switch 70 is not energized and moving device (a piston) 32 connected to rack gear 30 is extended so that "U" shaped member 35 is in a first position as shown. In this position cloth 4, threaded through "U" shaped member 35, is forced onto upstanding ribs 29 on drum 26. Cloth 4 then is moved by drum 28 onto trough 25-1, (see FIG. 3) and is propelled down trough 25-1 by bleach liquor 33 under pressure coming from pressure tank 19. Cloth 4 passes through guide arms 34 prior to it being threaded to arm 35. When grate 23 is moved to its second position, see solid lines of element 23 in FIG. 5, switch 70 is energized to cause moving device (piston) 32 and the attached rack gear 30 to rotate pinion gear 31 to a second position as shown, thus causing "U" shaped arm 35 to move to a second position, as shown in FIG. 5. By so moving to this second position, cloth 4 is removed from substantial connection with drum 28, thus preventing additional cloth 4 from entering kier 12 via troughs 25-1 through 25-7. Trough 25-1 does not have elements 32, 35, 74, 30 and 31. All other troughs do. Details of "U" shaped member 35 are shown in FIGS. 7 and 8, where upstanding arms 68, cross members 67 and 69 define an aperture through which cloth 4 is threaded.

Figure 12:
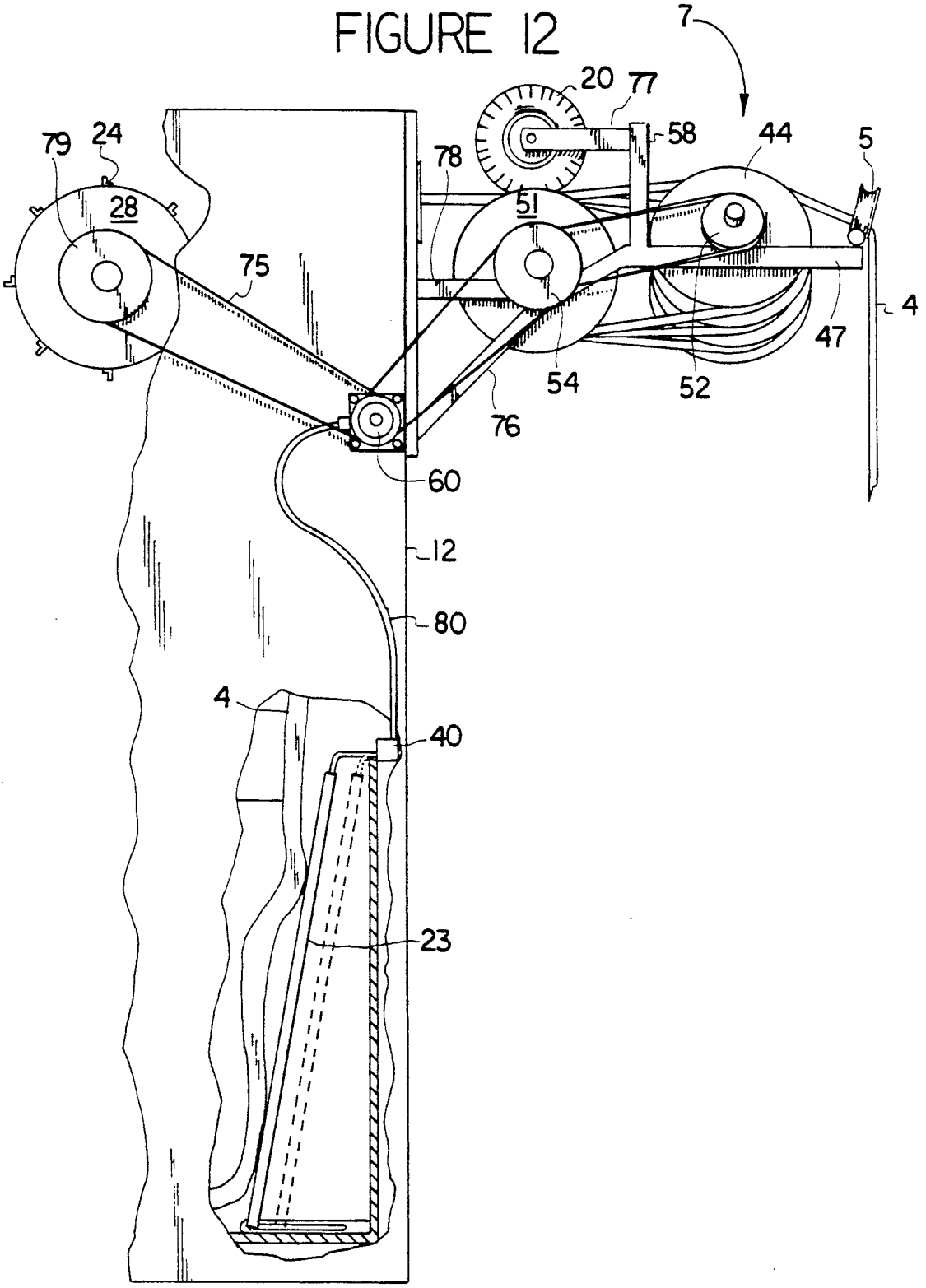
FIG. 12 is a fragmentary side elevation of the moving device of FIG. 11.

Reference is made to FIG. 12 and more particularly to switch 40, which can actuate or slow down motor 60. Motor 60 via drive belt 75 is affixed to drive pulley 79, which is affixed to drum 28 to drive same. Drive belt 76 is connected to drum pulley of conveying device 7 to rotate drive pulley 52. By so doing, axles 56 and 57 are rotated (see FIG. 11) thus rotating pulleys 44, 45, 46, 50, 51 and 49. The interaction between these last mentioned pulleys and cloth 4 causes cloth 4 to be conveyed along a predetermined path. The details of conveying device will be explained later.

Once grate 23, subtended by trough 25-1, the trough of the second set at the extensive left as viewed as per FIG. 10, is moved by piled up cloth 4 (see FIG. 5 for example), switch 40 is activated causing motor 60, which drives both drum 28 and conveying device, to stop or slow down as desired. When the piled up cloth is removed, grate 23 moves from solid line (second) position to dotted line (first position) deactivating switch 40, motor 60, drum 28 and conveying device 7.

Reference is now made to FIG. 10. Here there is shown drum 28 and upstanding ribs 29. Not shown, for the purpose of clarity, are the "U" shaped arm 35 and associated gears/piston to operate same for each trough except the extreme left hand trough, i.e. the one subtended by trough 25-1. However, it is to be understood that "U" shaped arms 35 and associated apparatus, as shown in FIG. 4 and 5, are to be provided for the balance of the second set of troughs. In FIGS. 2 and 3, it will be recognized that cloth 4 enters bleaching kier 12 over drum 28, is fed into trough 25-1 of the first set of troughs, traverses the length of this trough, drops into the extreme left most trough of the second set of troughs, is traversed in this trough in a reverse direction the length of the kier 12 through the bleaching liquor, moved over drum 28 onto trough 25-2 and then traversed the length of trough 25-2, into bleaching liquor in the second from the left trough of the second set of troughs, then in such trough in a reverse direction through the bleaching liquor back to drum 28. Like repetitive routes are traversed until cloth 4 has traversed all troughs of both first and second sets. Afterwards, cloth 4 is extended, from a rope like configuration to an extended configuration 4', where there are created two lateral creases 102, 103, by squeeze roll 40. This squeeze roll subtends gas jet 37, connected by hose 38 to a source of gas under pressure 101. By causing a stream of gas to impinge upon cloth 4 plus the squeezing of air entrapped inside of tubular cloth 4 by squeeze rolls 40, cloth 4 expands to cloth 4', with squeeze rolls 40 imparting lateral creases 102–103 thereto. Such action removes a large portion of the entrapped bleach liquor from cloth 4 and this reduces the time cloth 4' must spend in counter flow washer 15.

At each terminal end of troughs 25-1 through 25-7 is sensor 22. See FIGS. 3 and 9. When cloth 4 backs up or accumulates against sensor probe 36, located in 25-1, motor 60 is either slowed down or stopped, as predetermined, thus slowing down or stopping conveying device 7 and drum 28. See FIG. 15. In all other troughs 25-2 through 25-7, sensor 22 is connected to switch 70 (FIGS. 4 and 5) to activate moving device 32 which as previously explained, essentially removes cloth 4 from ribs 24 of drum 28 and puts it back in response to the absence or presence of a predetermined mass of cloth. See FIG. 16.

Figure 13:
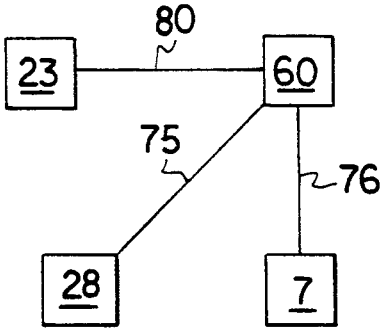
FIG. 13 is a schematic of the conveying device 7, motor 60 and drum 28 of FIG. 12 connected to and responsive to grate 23.
Figure 14:
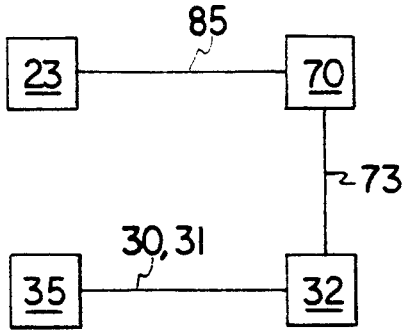
FIG. 14 is a schematic showing moving device 32 and arm 35 connected to switch 70 and responsive to grate 23.
Figure 15:
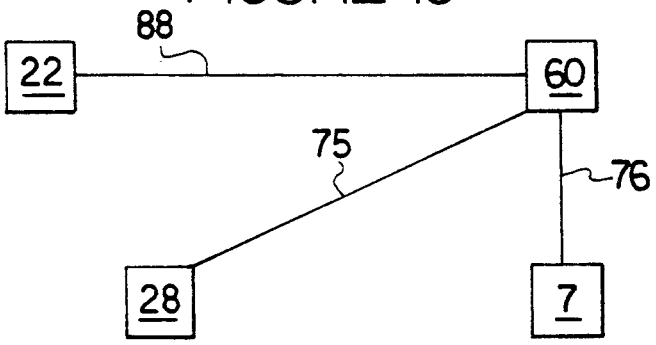
FIG. 15 is a schematic showing conveying device 7 and drum 28 under the control of and responsive to motor 60 and sensor 22.
Figure 16:
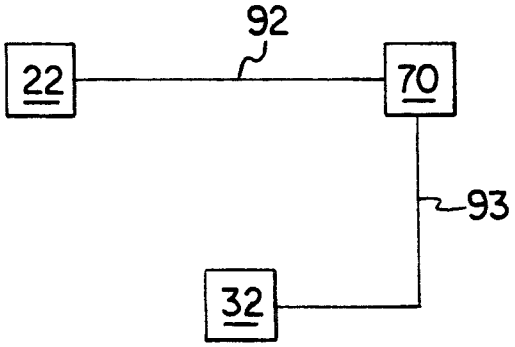
FIG. 16 is a schematic showing moving device 32 under the control of and responsive to switch 22 and grate 32.

Shown by the schematic shown in FIG. 13 grate 13 (the one that is in the extreme left arm trough of the second set of troughs, viewing this kier as per FIG. 10) via lead 80 is connected to motor 60, which drives conveying device 7 by drive belt 76 and drum 28 via drive belt 75. The schematic of FIG. 14 shows all the rest of grates 23 connected by element 85 to switch 70, which activates piston 32 and which through rack 30 pinion gear 31 moves "U" shaped member 68–69 in the manner previously described. Pinion gear 31 is affixed to "U" shaped member 68–69 and to bracket 74. In FIG. 15 sensor 22 in trough 25-1 is shown to be connected to motor 60 via lead 88. Motor 60, is connected to and drives conveying device 7 via drive belt 76 and drum 28 via drive belt 75. FIG. 16 depicts, in a schematic fashion, the sensors in troughs 25-2 through 25-7, connected to switch 70 via lead 92, which is connected to moving device 32 through lead 93, which moves control device as shown in FIGS. 4 and 5 as previously described.

Figure 9:
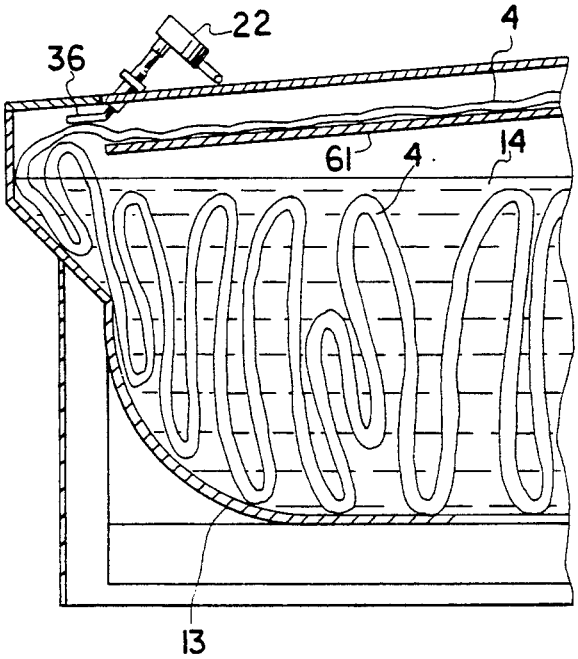
FIG. 9 is a fragmentary front elevation of the left hand terminal portion of the water slide 61 of FIG. 5.
Figure 17:
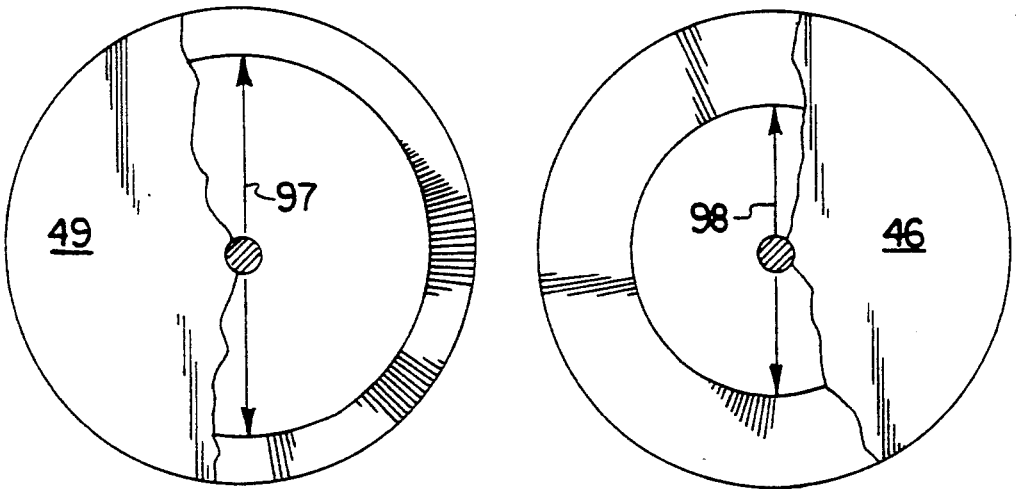
FIG. 17 is a fragmentary side elevation comparing the diameters of pulleys 49 and 46 of FIG. 11.

Reference is now made to FIGS. 9, 11 and 17 in which there is described a conveying device that conveys cloth 4, in a rope like configuration, in a predetermined path without imparting any substantial creases thereon. In FIG. 11 elements 47 and 48 delimit a frame in which axles 56 and 57 are rotatably journaled. Affixed to axle 57 are pulleys 44, 45 and 46. Affixed to axle 56 are pulleys 49, 50 and 51. Cloth 4, from dry J-box 27, is threaded through guide 8, traversed over part of pulley 44, around a part of pulley 51, from the bottom of pulley 51 to the bottom of pulley 45, around a top portion of pulley 45, to and around a top portion of pulley 50, around a bottom portion of pulley 50 to and around a bottom portion of pulley 46, around a top portion of pulley 46 to and over a top portion of pulley 49 thence through guide 8. Note the relative position, in the vertical plane, of axle 56 vs axle 57. One is at an angle to the other. Also note FIG. 17 and the throats of pulleys 46 and 49. This teaches that the diameter 97 of pulley 49 is larger than the diameter of pulley 98. Optimally, the diameter of pulley 49 is larger than pulleys 46, 45, 44, 51 and 50. With respect to the angle between axles 56 and 57, such should be so that cloth 4, whatever size it may be, delimits and traverses over a straight and level path as cloth 4 passes from one pulley to another. Element 20, is a rotatable wheel member, supported by brackets 58 and 77. Part of element 20 is disposed in pulley 49.

Bleaching liquor 14 is usually maintained at a temperature between 160° F. to 80° F. by heat exchanger 24 and may be composed of the following ingredients:

| | |
|---|---|
| 50% Caistic Soda | 1.4% to 2.0% O.W.M. |
| Sodium Silicate | 1.0% to 1.5% O.W.M. |

-continued

| | |
|---|---|
| Hydrogen Peroxide 50% | 2.25% to 2.5% O.W.M. |
| Wetting Agent | 0.2% to 0.4% O.W.M. |
| Sequestering Agent | 0.2% to 0.4% O.W.M. |

Cloth 4 is in the bleaching kier for 45.50 minutes. Counter flow washer 15 and wet box 18 are prior art devices that form no part of the present invention and are available from Jemco of Icard, N.C.

What is claimed is:

1. An apparatus for conveying flaccid material comprising:

(a) a conveying device and a controller;

(b) a container to which the conveying device is affixed and in which there is disposed first and second sets of troughs;

(c) a first detection device, disposed in a terminal portion of at least one of said second set of troughs, in communication with said conveying device and said controller and responsive to an accumulation of flaccid materials nearby said first detection device to slow down and/or stop said controller and conveying device; and, (d) a second detection device, disposed in a terminal portion of one of said first set of troughs, in communication with said conveying device and said controller and responsive to an accumulation of flaccid materials nearby said second detection device to deactivate said controller and said conveying device and responsive to an absence of said accumulation to activate said controller and conveying device.

2. The apparatus of claim 1 wherein said controller further includes a moving device which includes a "U" shaped arm connected thereto and another first detection device, disposed in a terminal portion of at least one other of said second set of troughs, connected to said moving device responsive to cause said "U" shaped arm to move from a first to a second position in response to said accumulation of elongated flaccid material and from a second to a first position in absence of such accumulation of elongated flaccid material.

3. The apparatus of claim 1 wherein said controller further includes a moving device, which includes a "U" shaped arm connected thereto, and another second detection device disposed in a terminal portion of at least one other of said first set of troughs, connected to said moving device responsive to cause said "U" shaped arm to move from a first to a second position in response to said accumulation of elongated flaccid material and from a second to a first position in absence of such accumulation of elongated flaccid material.

4. The apparatus of claim 1 wherein said conveying device includes:

(a) a first rotatable axle having a longitudinal axis, on which there is disposed a plurality of pulleys;

(b) a second rotatable axle, having a longitudinal axis, on which there is a plurality of pulleys, said longitudinal axis of said second rotatable axle being disposed at an angle to said first rotatable axle so that an elongated mass of flaccid material traversed about said plurality of pulleys on said first and second rotatable axles conveys said elongated mass of flaccid material along a predetermined path without imparting a crease thereto.

5. The apparatus of claim 4 wherein each of said pulleys has a terminal portion in the shape of a "U"

shaped groove and the diameter of one of said pulleys, measured from the center of said first pulley to the bottom of said groove, is greater than a like diameter of any other pulley.

6. The apparatus of claim 4, further including:

(a) a "U" shaped groove in the terminal portion of one of said pulleys; and, (b) a third axle and a rotatable wheel disposed thereon, a portion of said wheel disposed in said "U" shaped groove.

7. The apparatus of claim 4 wherein said plurality of pulleys on said first rotatable axle comprises first, second and third pulleys.

8. The apparatus of claim 7 wherein said plurality of pulleys on said second rotatable axle comprises forth, fifth and sixth pulleys.

9. The apparatus of claim 8 further including an elongated mass of flaccid material traversed around portion of said first pulley, around a portion of said fourth pulley, around a portion of said second pulley, around a portion of said fifth pulley, around a portion of said third pulley, and around a portion of said sixth pulley, said elongated mass of flaccid material delimiting travel paths between said first and fourth, said fourth and second, said second and fifth, said fifth and third, and said third and sixth pulleys in essentially straight lines.

10. The apparatus of claim 1 wherein said first set of troughs is disposed above said second set of troughs, and the troughs of said first set are aligned at an angle to the troughs of said second set.

11. The apparatus of claim 1 further including a first detection device disposed in a terminal portion of all other troughs of said second set of troughs and wherein said controller further includes a moving device and a "U" shaped arm, through which elongated flaccid material may be threaded, and movable from a first to a second and from said second to said first by said moving device, said moving device in communication with at least one of said first detection devices and responsive to an accumulation of elongated flaccid material near said last mentioned first detection device to cause said "U" shaped arm to move from a first to a second position and in absence of an accumulation of elongated flaccid material to cause said "U" shaped arm to move from said second to said first position.

12. The apparatus of claim 1 further including a second detection device disposed in a terminal portion of all other troughs of said second set and wherein at least one of said last mentioned second detection devices is connected to said conveying device and said controller and is responsive to an accumulation of elongated flaccid material near said last mentioned second detection device to slow down or stop said controller and said conveying device and responsive to an absence of said accumulation to cause said controller and conveying device to rotate.

13. The apparatus of claim 12 wherein said controller further includes a "U" shaped arm and a moving device connected at least one of said last mentioned detection devices, for moving said "U" shaped arm from a first to a second position in response to said accumulation of elongated flaccid material and from a second to a first position in absence of such accumulation of elongated flaccid material.

14. The apparatus of claim 8 further including a quantity of elongated flaccid material traversed around a portion of said first pulley, around a portion of said fourth pulley, around a portion of said second pulley, around a portion of said fifth pulley, around a portion of said third pulley, and around a portion of said sixth pulley, said elongated flaccid material delimiting travel paths between said first and fourth, said fourth and second, said second and fifth, said fifth and third, and said third and sixth pulleys in essentially straight lines.

15. The apparatus of claim 1 wherein said controller includes a rotatable reel and further including a quantity of elongated tubular shaped flaccid material, circumscribing a portion of said rotatable reel, a set of squeeze rolls between which said tubular shaped flaccid material is traversed in an extended state as a result of said rolls entrapping and compressing gas within that part of the tubular shaped flaccid material passing through said squeeze rolls and a device for emitting gas under pressure so directed at said elongated tubular shaped flaccid material that gas under pressure may impinge upon a portion of the elongated tubular shaped flaccid material prior to it passing through said squeeze rolls.

16. The apparatus of claim 1 wherein said first detection device is a grate having openings therein small enough to prohibit the passage of flaccid material but large enough to allow passage of bleach liquor, said grate being pivotally mounted to a terminal portion of said second troughs.

17. The apparatus of claim 1 further including a washer, a conduit communicating said washer with said container, and a nozzle in said conduit for spraying liquid under pressure on said elongated flaccid material and conveying said elongated flaccid material from said container to said washer.

18. The apparatus of claim 1 further including a washer and a conduit communicating with said washer and said container, said conduit having at least one nozzle for delivery of liquid under pressure to elongated flaccid material in said conduit to propel said elongated flaccid material to said washer.

* * * * *

UNITED STATES PATENT AND TRADEMARK OFFICE

CERTIFICATE OF CORRECTION

PATENT NO. : 5,119,646

DATED : June 9, 1992

INVENTOR(S) : Jimmy R. Jacumin

It is certified that error appears in the above-identified patent and that said Letters Patent is hereby corrected as shown below:

In Column 4, line 67, delete first word "#shown" and replace with the word -- shown --.

In Column 7, line 16, delete Arabic numeral "13" (second occurrence) and insert -- 23 --.

Signed and Sealed this

Third Day of August, 1993

*Attest:*

*Attesting Officer*

Michael K. Kirk

MICHAEL K. KIRK

*Acting Commissioner of Patents and Trademarks*